United States Patent [19]

Murphy

[11] Patent Number: 4,945,955

[45] Date of Patent: Aug. 7, 1990

[54] HAZARDOUS WASTE REMOVAL DEVICES

[75] Inventor: Dennis Murphy, Tucson, Ariz.

[73] Assignee: Burr-Brown Corporation, Tucson, Ariz.

[21] Appl. No.: 171,949

[22] Filed: Mar. 23, 1988

[51] Int. Cl.[5] ..... B65B 31/04

[52] U.S. Cl. ..... 141/65; 141/94; 141/59; 141/369; 417/144; 417/145; 137/205; 222/65

[58] Field of Search ..... 141/4, 5, 7, 8, 59, 141/65, 67, 94, 95, 369, 378; 222/56, 64, 65; 137/205; 417/144, 145, 148, 149, 143, 138, 121

[56] References Cited

U.S. PATENT DOCUMENTS

| | | | |
|---|---|---|---|
| 2,682,886 | 1/1951 | Paxton | 137/205 |
| 2,937,836 | 5/1960 | Fleischman | 248/141 |
| 3,091,252 | 8/1961 | Jones | 137/392 |
| 3,780,757 | 12/1973 | Jordan | 417/149 |
| 4,263,932 | 4/1981 | Laar et al. | 137/101.27 |
| 4,377,246 | 3/1983 | McMillin et al. | 222/56 |
| 4,386,637 | 6/1983 | Buchanan et al. | 141/65 |
| 4,432,700 | 2/1984 | Icking | 137/205 |
| 4,549,570 | 10/1985 | Cook et al. | 137/389 |
| 4,599,048 | 7/1986 | Stewart et al. | 417/149 |
| 4,601,409 | 7/1986 | DiRegolo | 222/1 |
| 4,603,709 | 8/1986 | Huisma | 137/205 |
| 4,641,680 | 2/1987 | Been | 137/312 |
| 4,818,706 | 4/1989 | Starr | 417/148 |
| 4,828,461 | 5/1989 | Laempe | 417/132 |

FOREIGN PATENT DOCUMENTS

| | | | |
|---|---|---|---|
| 1153845 | 5/1969 | United Kingdom | 141/59 |

*Primary Examiner*—Henry J. Recla
*Assistant Examiner*—Edward C. Donovan
*Attorney, Agent, or Firm*—Cahill, Sutton & Thomas

[57] ABSTRACT

An apparatus for transferring toxic waste liquid directly into a 55 gallon waste drum includes a mobile drum cradle that lifts the drum so it can be moved to a container presently holding the toxic liquid. A vacuum is produced in a transfer reservoir, and an inlet valve of the tank is opened and a dump valve of the tank is closed. The vacuum draws waste liquid through a tube and the inlet valve into the transfer reservoir until a full condition is sensed. The vacuum then is released, the inlet valve is closed, and the dump valve is opened, dumping waste liquid from the transfer reservoir through the dump valve directly into the drum. This procedure is automatically repeated until all of the waste liquid is transferred or a drum full condition is sensed. The drum is then carried to a disposal site by the mobile drum cradle.

9 Claims, 3 Drawing Sheets

HAZARDOUS WASTE REMOVAL DEVICES

BACKGROUND OF THE INVENTION

The invention relates to devices for effectuating safe removal of hazardous liquids from industrial work stations, and more particularly to a device and method for safely transferring toxic liquids from a basin or container into a 55 gallon industrial waste barrel and moving the barrel to a dock for loading onto a vehicle.

In various industries, such as the semiconductor industry, large amounts of toxic liquid waste material are produced. Toxic liquid waste materials include various dangerous acids, etchants, solvents, and the like. The problem of disposing of such waste liquid without spillage or splashing and resulting injury to employees presents a serious problem. In the past, portable pumping devices have been used to transfer such waste materials from workstation sinks, basins, etc. into five gallon containers or the like. The contents of such containers then have been poured by employees into conventional 55 gallon waste barrels, using funnels. The waste barrels then are shipped to suitable waste disposal sites. The 55 gallon waste barrels usually have a threaded two inch diameter opening on top, into which a threaded cap or plug is tightly installed to prevent spillage after the waste barrel is filled. Injury or damage to workers and property occasionally occurs due to spillage during transfer of liquid waste material from the utilization site to the five gallon containers and spillage, splashing, and overfilling during transfer into the 55 gallon waste barrels. Injury or damage also occasionally result from accidental dropping of the five gallon containers.

Thus, there is a presently unmet need for a reasonably inexpensive, practical, safe means for transferring toxic liquid waste material into conventional 55 gallon waste barrels or the like.

SUMMARY OF THE INVENTION

Accordingly, it is an object of the invention to provide an apparatus and method for safely, directly removing toxic liquid waste material from a container, basin, or the like directly into sealable waste disposal barrels or containers without substantial danger of spillage, leakage, splashing, etc.

Briefly described, the invention provides an apparatus for transferring hazardous liquid into a storage drum. One embodiment includes a mobile base supported by wheels on a floor, an upright member attached to the base, a drum cradle connected to the upright member and a clamp assembly clamping the drum to the drum cradle and jack for raising and lowering the drum cradle and the drum to allow transporting the drum by rolling the base on the floor. A transfer reservoir has an inlet valve coupled to an inlet tube and a dump valve connected to a dump tube extending into an opening in the top of the drum. A vacuum is produced in the transfer reservoir when the dump valve is closed and the inlet valve is open, drawing hazardous fluid through the inlet tube and into the interior of the reservoir, until a full reservoir condition is sensed. The vacuum then is released, the inlet valve is closed, and the dump valve is opened, allowing contents of the transfer reservoir to be emptied into the drum. This procedure is automatically repeated until all of the hazardous liquid has been transferred into the drum or a full drum condition is sensed, in which case the dump valve is closed.

DESCRIPTION OF THE PREFERRED EMBODIMENT

Figures 1, 2:
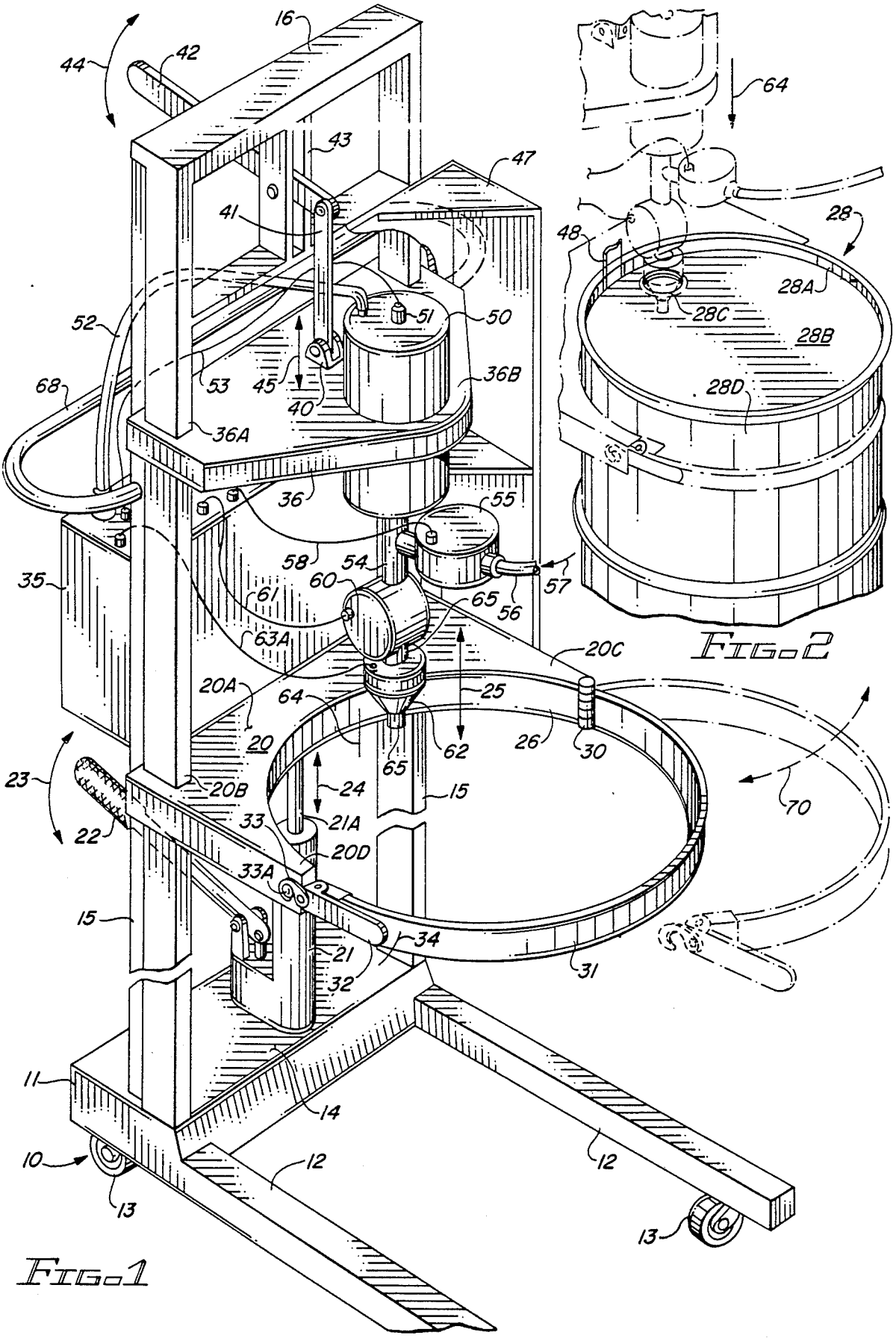
FIG. 1 is a partial perspective view of the waste removal apparatus of the invention.
FIG. 2 is a partial perspective view useful in describing the operation of the apparatus of FIG. 1.

Referring now to the drawings, waste disposal device 10 includes a base 11 including two horizonal arms 12 rigidly interconnected by a horizontal crossplate 14. Four casters 13 are supported on the opposite ends of arms 12. A pair of elongated, vertical uprights 15 are rigidly attached to the upper surface of crossplate 14. The upper ends of uprights 15 are rigidly interconnected by a horizontal cross member 16. The length of arms 12 is approximately 30 inches. The height of uprights 15 is approximately 6 feet. The length of crossplate 14 is approximately 30 inches.

A vertically moveable drum cradle 20 is supported on uprights 15. A suitable bearing assembly 20B (FIG. 3) is provided in rear section 20A of drum cradle 20.

A hydraulic jack 21 is supported on the horizontal upper surface of crossplate 14. A moveable piston 21A of hydraulic jack 21 moves upward in the directions of arrows 24 (FIG. 1) in response to actuation of jack handle 22 in the direction indicated by arrows 23. Jack handle 22 preferably is used as a foot peddle. A release valve allows jack 21 to lower drum cradle 20. Piston 21A is attached (See FIG. 3) to the bottom of drum cradle 20, effectuating raising and lowering of drum cradle 20 by jack 21.

A semicylindrical cutout 26 (FIG. 1) of rear section 20A of drum cradle 20 conforms to the cylindrical outer surface 28D of a conventional industrial 55 gallon waste drum 28 (FIG. 2). The radius of an upper flange 28A of drum 28 is slightly greater than the radius of the cylindrical wall section 28D.

Drum cradle 20 includes a hinge 30 connected to the outer end section 20C of stage 20. A stainless steel band 31 has hinged thereto at its opposite end a quick release latch handle 32. A hook 33 associated with quick release latch handle 32 engages a stop or peg 33A rigidly attached to the outer end 20D of drum cradle stage 20. Band 31 is utilized in conjunction with quick release latch handle 32 to secure waste drum 28 tightly against the semicylindrical surface 26 of drum cradle stage 20A, allowing drum 28 to be lifted and conveniently rolled on a factory floor to a waste disposal dock after drum 28 has been filled with toxic liquid in the manner hereinafter described. Thus, the operator does not have to lift, roll, or tilt the waste drum 28 during loading, use or unloading.

A control box 35 is attached to upright members 15, as shown.

Figure 3:
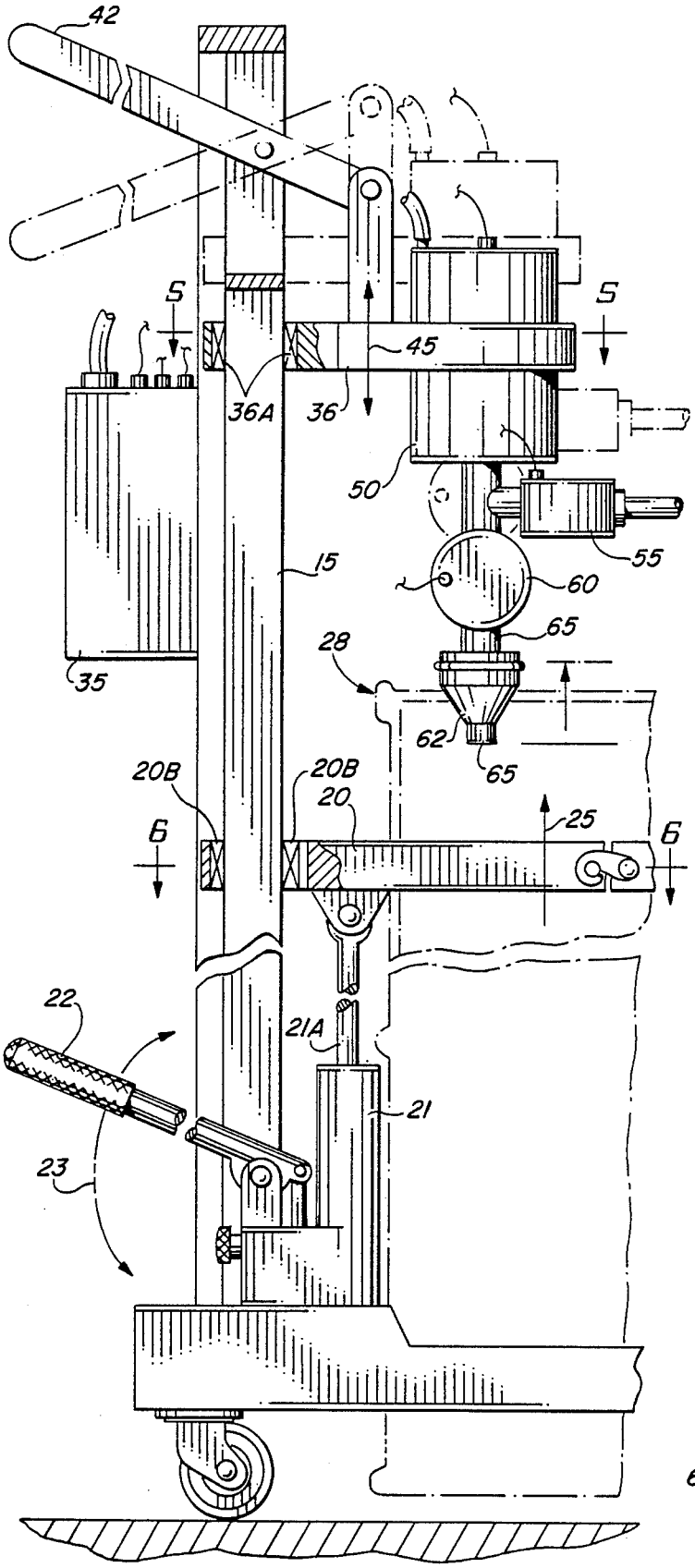
FIG. 3 is a partial side elevational view of the apparatus of FIG. 1.

Reservoir support stage 36 is moveably mounted on uprights 15 by a pair of guide bearing assemblies 36A, as shown in FIG. 3. Reservoir support stage 36 includes a forward part 36B which receives and supports a liquid transfer reservoir 50. Preferably, the transfer reservoir 50 is transparent so the operator can verify that the waste liquid is properly drawn into the transfer tank and dumped therefrom into waste drum 28 as the inlet valve 55 and dump valve 60 are alternately opened and closed.

A pair of spaced bosses 40 rigidly attached to the horizontal upper surface of reservoir stage 36 have pivotally journaled therebetween the lower end of a connecting rod 41, the upper end of which is pivotally connected to the right hand end of a lever 42. An intermediate portion of lever 42 is pivotally journaled between a pair of spaced bosses 43 that are rigidly attached to the bottom of upper cross member 16. The rear or left-hand end of handle 42 can be raised or lowered in the directions of arrows 44, causing reservoir stage 36 and liquid transfer reservoir 50 to be vertically moved in the direction of arrows 45.

A T-shaped conduit attached to the bottom of transfer reservoir 50 is connected to a pneumatically controlled inlet valve 55 and a pneumatically controlled dump valve 60. Inlet valve 55 receives a flexible waste fluid inlet tube 56, the free outer end of which can be placed in a basin or other container from which toxic waste liquid is to be removed. During operation, the toxic waste fluid is drawn through inlet tube 56 in the direction of arrow 57 through open inlet valve 55 and through T connector 54 into transfer reservoir 50 by a vacuum therein, as subsequently explained.

An inlet dump valve 60 is connected to the other opening of T connector 54. A tube 65 is connected to the outlet of dump valve 60 and passes through splash shield 62. Splash shield 62 has a tapered, resilient surface which is partially inserted into the two inch hole 28C in the top 28B of waste disposal drum 28 during transfer of toxic liquids thereto. A level sensor tube 63A connected to a pressure sensor 78 (FIG. 7) extends to the bottom of tube 65 to detect when enough toxic waste liquid has been transferred to fill waste drum 28.

Figure 7:
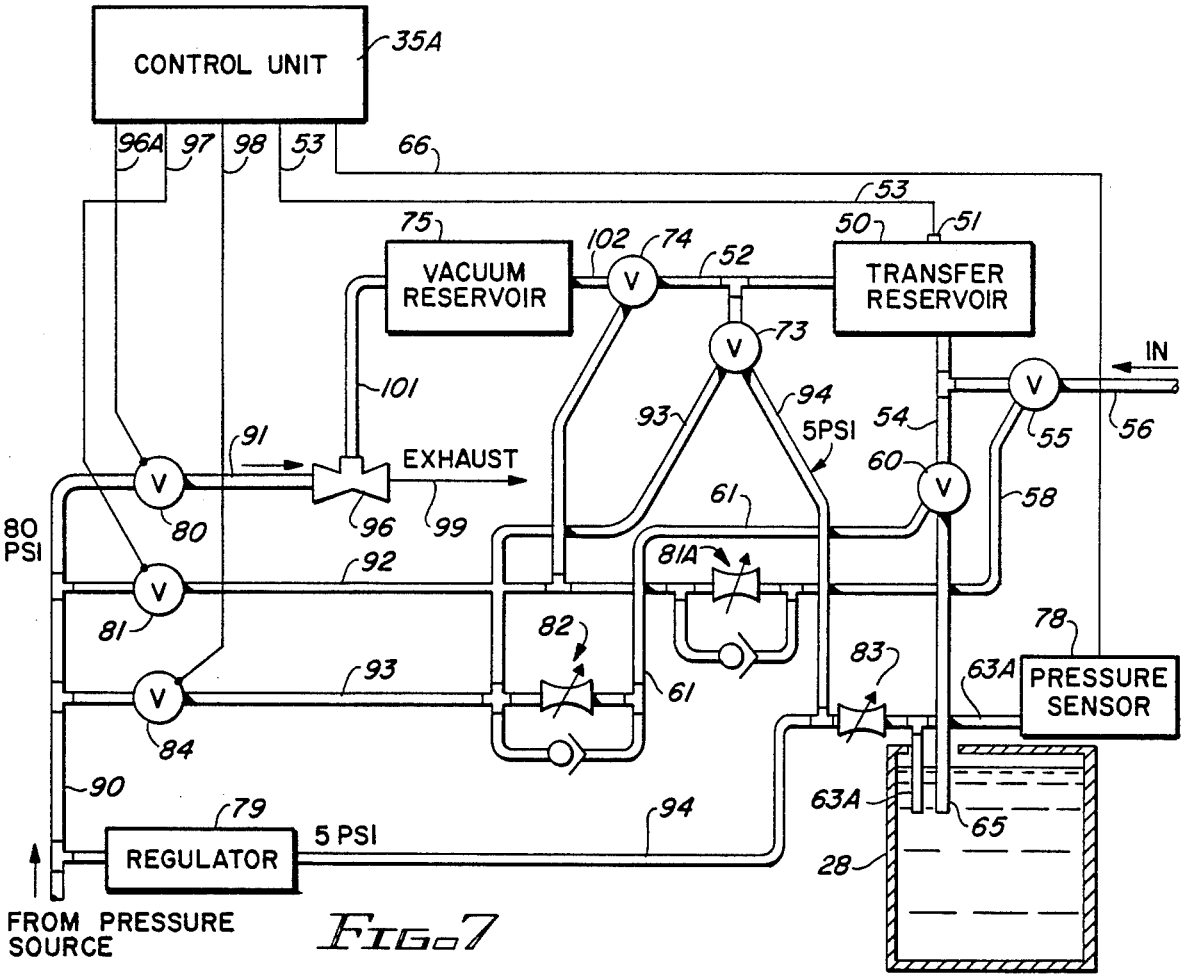
FIG. 7 is a schematic diagram illustrating the control connections, liquid tube connections, and pneumatic tube connections of the apparatus of FIG. 1.

Pneumatic tube 58 connects inlet valve 55 to control box 35. Pneumatic tube 61 connects dump valve 60 to control box 35. Tube 63A is connected to pressure sensor 78 (FIG. 7).

A vacuum tube 52 is connected between the interior of transfer reservoir 50 and a controlled vacuum source 96 (FIG. 7) by means of pneumatic valve 74 and vacuum reservoir 75. A level sensor 51 on the top of transfer reservoir 50 communicates with the interior thereof, indicating when it is filled. Level sensor 51 is connected by electrical conductor 53 to control unit 35A (FIG. 7), which is located inside control box 35 of FIG. 1. Vacuum reservoir 75, vacuum source 96, regulator 79, pressure sensor 78, one way flow restrictors 81 and 82, and valves 73, 74, 80, 81, and 84 also are located in control box 35.

Controlled vacuum source 96 (FIG. 7) is a Venturi jet past which a high pressure jet of air flows; this jet of air is produced by a high pressure (80 psi) air source through valve 80. Venturi device 96 produces the controlled vacuum, which then is applied to or disconnected from the interior of transfer reservoir 50 by means of valve 74 in accordance with the operation of control unit 35A.

As shown in FIG. 1, the reservoir stage and transfer reservoir 50 are partly shielded by a shroud 47 (partially shown) that is rigidly attached to stage 36. A retaining tab 48 (FIG. 2) rigidly attached to the bottom of shroud 47 engages an inner vertical surface of flange 28A of 55 gallon waste drum 28, as shown in FIG. 2, when reservoir stage 36 is lowered to effectuate transfer of toxic waste liquid into waste drum 28.

FIG. 7 schematically shows the connection of liquid valves, pneumatic valves, liquid lines, pneumatic lines, and control unit 35A in the presently preferred embodiment of the invention. An 80 psi (pounds per square inch) source of air or nitrogen is carried by pneumatic tube 90 into electrically controlled two-way solenoid valve 80 and three-way solenoid values 81 and 84, and the input of a pressure regulator 79, which produces an output pressure of 5 psi in pneumatic tube 94. Two-way solenoid valve 80 and three-way solenoid values 81 and 84 are controlled by control, unit 35A by means of electrical signals on conductors 96A, 97 and 98, respectively. The outlet of two way solenoid valve 80 is coupled by pneumatic tube 91 to the inlet of a Venturi vacuum generator 96, which then exhausts the compressed air or nitrogen, as indicated by arrow 99. A vacuum is thereby produced in pneumatic tube 101, which is connected to a vacuum reservoir 75. The outlet of vacuum reservoir 75 is connected by pneumatic tube 102 to an air operated valve 74, the outlet of which is coupled by vacuum line 52 to transfer reservoir 50. Normally closed air operated valve 74 is controlled by pressure in pneumatic tube 92, which is connected to the outlet of three-way solenoid valve 81. Pneumatic tube 92 also is connected to the inlet of a flow control valve 81A, which delays opening of normally closed air operated inlet valve 55.

Normally closed air operated air inlet valve 73 is coupled between vacuum line 52 and pneumatic tube 94, which is coupled to the 5 psi output of regulator 79. Air inlet valve 73 is controlled by pressure in pneumatic tube 93, which is coupled to the outlet of three-way solenoid valve 84. Pneumatic tube 93 also is connected to flow control valve 82 to delay opening of dump valve 60 via pneumatic tube 61. Pneumatically controlled dump valve 60, when opened, dumps the contents of transfer reservoir 50 via tube 65 into waste storage drum 28. Air inlet valve 73 is opened by pressurized air in tube 93 in response to opening of valve 84 by control unit 35A while transfer reservoir 50 is being dumped. Opening of air inlet valve 73 allows low pressure 5 psi air in tube 94 to be forced into transfer reservoir 50 to replace toxic waste that is being dumped through dump valve 60. The increased 5 psi air pressure improves the rate of dumping.

The 5 psi pressure in pneumatic tube 94 also is connected to a flow restrictor 83, the outlet of which is coupled to pneumatic tube 63A, which extends into the interior of waste drum 28. When the level of waste liquid in drum 28 rises to within about 4 inches from its top, the pressure in pneumatic tube 63A increases and is detected by pressure sensor 78, which produces a corresponding electrical signal on electrical conductor 66.

One skilled in the art can readily provide a suitable control unit 35A programmed to generate the needed control signals on conductors 96A, 97 and 98 in response to manual control switches and the level sensor 51 and pressure sensor 78 to produce the operation described above.

In operation, waste disposal device 10 is rolled, using handle 68, up to a conventional waste drum 28 resting on the floor. Latch handle 34 is released, and band 31 is swung outward in the direction of arrow 70. Waste disposal device 10 is then rolled toward the drum so that the horizonal base arms 12 extend on either side thereof. The jack 21 is operated to lower drum cradle stage 20 so that the semi-cylindrical surface 26 snugly fits around the upper cylindrical wall of the drum 28 just below flange 28A. The band 31 is reattached to end 20D of the drum cradle stage and locked thereto, tightly securing drum 28 to the waste removal apparatus 10. Jack handle 22 then is actuated, raising drum cradle 20 and barrel 28. The waste removal apparatus 10 then is rolled to a working area from which toxic liquid must be removed. Jack 21 is operated to lower drum 28 onto the floor with the drum remaining fastened to stage 20, causing the drum to serve as a brake to prevent the device from rolling.

Figure 4A:
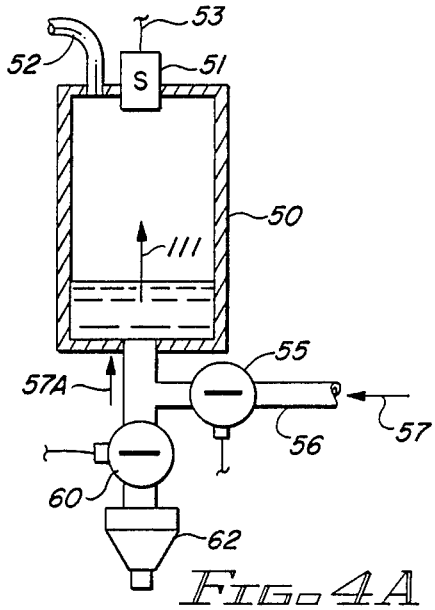
FIGS. 4A–4C are section view diagrams useful in illustrating the operation of the apparatus of FIG. 1.
Figure 4B:
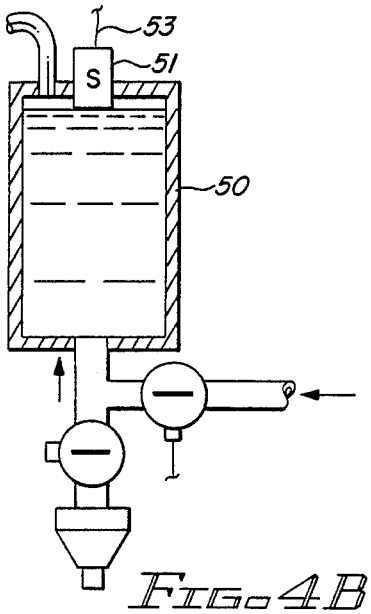
Figure 4C:
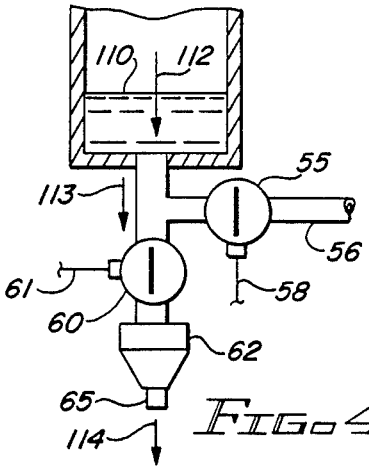
Figure 5:
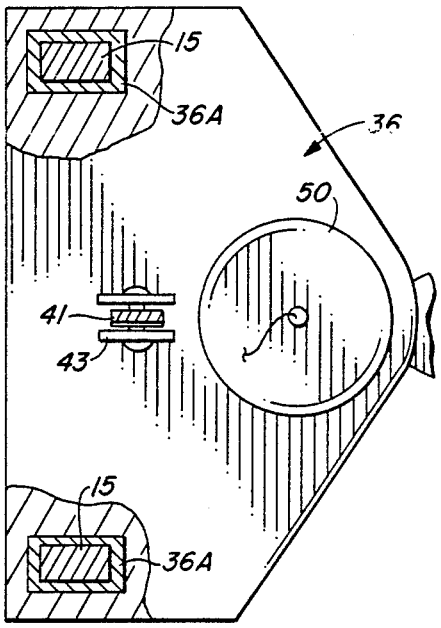
FIG. 5 is a section view taken along section line 5—5 of FIG. 3.
Figure 6:
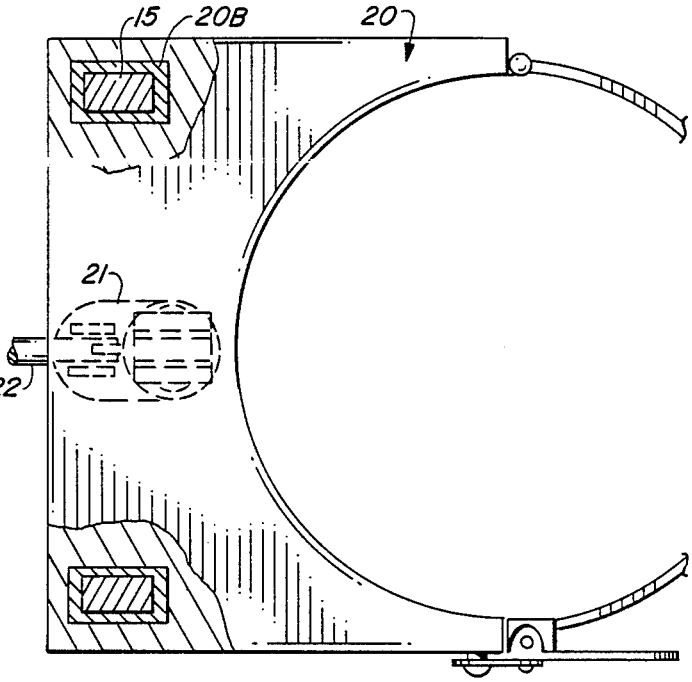
FIG. 6 is a section view taken along section line 6—6 of FIG. 3.

The free end of inlet hose 56 is inserted into the toxic liquid to be disposed of. Upper handle 42 (FIG. 1) then is raised, lowering transfer reservoir 50 and splash shield 62 so that the lower part of splash shield 62 extends into the two inch threaded hole 28C of waste drum 28. A control switch in control unit 35A then is actuated, causing valve 80 to open, causing valve 81 to open, and causing valve 84 to be closed. Opening of valve 81 causes 80 psi air pressure to be present in tubes 92 and 58, causing normally closed vacuum valve 74 to open and causing normally closed liquid inlet valve 55 to open. Valve 84, by being closed, causes pressure in tubes 93 and 61 to be relieved, so normally closed air inlet valve 73 and normally closed dump valve 60 remain closed. The vacuum draws toxic liquid safely through inlet hose 56 and inlet valve 55 into transfer reservoir 50, as indicated by arrow 111 in FIG. 4A, without any possibility of spillage or splashing of the toxic liquid. This continues until the level of toxic liquid in reservoir 50 reaches level sensor 51, as indicated in FIG. 4B, which then sends a signal via conductor 53 to control unit 35A. Control unit 35A then automatically closes valve 81 and opens valve 84. Closing valve 81 releases the pressure in tubes 92 and 58, which allows normally closed vacuum valve 74 to close and allows normally closed liquid inlet valve 55 to close. The opening of valve 84 produces 80 psi air pressure in tubes 93 and 61, which opens normally closed air inlet valve 73 and opens normally closed dump valve 60. Closing vacuum valve 74 disconnects the vacuum source from transfer reservoir 50. Open dump valve 60 then safely discharges the contents of transfer reservoir 50 directly into waste drum 28, as shown in FIG. 4C. Open air inlet valve 73 allows 5 psi air in tube 94 to be forced through tube 52 into transfer reservoir 50 to replace liquid being dumped through open dump valve 60. Control unit 35A allows enough time for all of the toxic liquid in transfer reservoir 50 to be discharged into waste drum 28 before closing dump valve 60 air inlet valve 73 reopening inlet valve 55, and reopening valve 74 to reapply the vacuum to transfer reservoir 50.

The foregoing operation is automatically repeated until the manual control unit on/off switch is turned off by the operator after all of the toxic liquid has been removed from the basin or other container, or until pressure sensor 78 detects that waste barrel 28 is filled and sends a corresponding signal via conductor 66 to control unit 35A. Control unit 35A then turns off inlet valve 55 and dump valve 60 and effectively disconnects the vacuum source from transfer reservoir 50. The operator then removes inlet hose 57 from the toxic liquid source, actuates jack 21 to lift the full waste barrel 28 and using handle 68, rolls the waste removal apparatus 10 and the filled waste drum 28 supported thereby to a suitable storage location.

When the level of toxic liquid in waste barrel 28 rises above the open lower end of tube 63A (FIG. 7), the increase of air pressure in tube 63A is sensed by pressure sensor 78, causing it to generate a "barrel full" signal on conductor 66.

After the drum 28 has been lowered onto the floor and the waste disposal device 10 withdrawn from the drum, a suitable seal cap is fitted into the opening 28C, thereby sealing the waste disposal drum 28.

Interlocks (not shown) prevent the system from operating unless proper conditions exist. A drum interlock is provided that requires the drum to be secured in place before the control unit permits proper operation. A stage interlock requires the transfer reservoir stage 36 to be lowered so that the dump tube 63 extends into the waste drum 28. A brake interlock requires that the 55 gallon drum be lowered to the floor before transfer operation can occur. A manual switch can be provided allowing any liquid remaining in the transfer tank to be dumped into the waste drum 28 by pressing a manual dump switch, bypassing the "drum full" interlock.

While the invention has been described with reference to a particular embodiment thereof, those skilled in the art will be able to make various modifications to this described embodiment without departing from the true spirit and scope of the invention. For example, the transfer reservoir stage 36 and the transfer reservoir and associated valves and tubes can be supported by a wall in such a manner that they are vertically movable in the manner described above. The waste drums then can be positioned beneath the transfer reservoir, which then can be lowered so that tube 65 extends into hole 28C, and liquid transfer proceeds as described above.

I claim:

1. Apparatus for transferring hazardous liquid from a container into a storage drum, comprising in combination:

(a) a base supported on a floor by wheels;
(b) an upright member attached to the base;
(c) a drum cradle connected to the upright member and a clamp assembly releasably attaching the drum to the drum cradle;
(d) means for raising and lowering the drum cradle and the drum attached thereto to allow transporting the drum by rolling the base along the floor;
(e) a transfer reservoir;
(f) an inlet valve coupled between the transfer reservoir and an inlet tube;
(g) a dump valve coupled between the transfer reservoir and a dump tube extending into an opening in the top of the drum;
(h) reservoir sensing means for providing a first signal if the transfer reservoir is full, and means for producing a second signal after dumping contents of the transfer reservoir;
(i) first means for producing a vacuum in the transfer reservoir, closing the dump valve, and opening the inlet valve to draw hazardous liquid into the transfer reservoir in response to the second signal;

(j) second means for sensing when the transfer reservoir is full, releasing the vacuum in the transfer reservoir, closing the inlet valve, and opening the dump valve to dump the hazardous liquid in the transfer reservoir into the drum in response to the first signal; and (k) a transfer reservoir stage supporting the transfer reservoir and the third means for raising and lowering the reservoir.

2. The apparatus of claim 1 including means for producing a third signal if the drum is full and means for releasing the vacuum in the transfer reservoir, closing the inlet valve, and closing the dump valve in response to the third signal.

3. The apparatus of claim 2 including a dump switch for producing the first signal and means for opening the dump valve in response to the first signal.

4. The apparatus of claim 3 wherein the base includes two spaced parallel horizontal members extending on either side of the drum and casters on their opposite ends and a crossplate attached to an end of each of the horizontal members.

5. The apparatus of claim 4 wherein the raising and lowering means includes a hydraulic jack supported on the base.

6. The apparatus of claim 1 wherein the drum cradle includes a drum stage with a semicircular cutout and first and second opposite outer ends and a strap connected at one end to first outer end and a quick release latch connected to the second end.

7. The apparatus of claim 1 including an air inlet valve connected to the transfer reservoir allowing air to pass into the transfer reservoir as liquid is dumped therefrom.

8. The apparatus of claim 7 including means for introducing low pressure air into the transfer reservoir when the air inlet valve is open.

9. The apparatus of claim 1 including an inlet-outlet tube connected to bottom of transfer reservoir, a T connector connecting the inlet-outlet tube to the inlet valve and the dump valve, the third means lowering the transfer reservoir, inlet-outlet tube, dump valve, and dump tube and a splash shield to lower the dump tube into an opening in the top of the drum.

* * * * *